US005528657A

United States Patent [19]

Vonk

[11] Patent Number: 5,528,657

[45] Date of Patent: Jun. 18, 1996

[54] X-RAY APPARATUS

[75] Inventor: Gerrit J. Vonk, Almelo, Netherlands

[73] Assignee: U.S. Philips Corporation, New York, N.Y.

[21] Appl. No.: 184,320

[22] Filed: Jan. 21, 1994

[30] Foreign Application Priority Data

Jan. 20, 1993 [EP] European Pat. Off. ..... 93200143

[51] Int. Cl.[6] ..... H05G 1/34

[52] U.S. Cl. ..... 378/110; 378/101

[58] Field of Search ..... 378/110, 109, 378/101

[56] References Cited

U.S. PATENT DOCUMENTS

| | | | |
|---|---|---|---|
| 4,614,999 | 9/1986 | Onodera et al. | 378/110 |
| 5,067,143 | 11/1991 | Watanabe et al. | 378/110 |
| 5,121,317 | 6/1992 | Vogler | 363/96 |

FOREIGN PATENT DOCUMENTS

| | | |
|---|---|---|
| 0408167 | 1/1991 | European Pat. Off. . |
| 2116064 | 10/1972 | Germany . |

*Primary Examiner*—Craig E. Church
*Attorney, Agent, or Firm*—Jack D. Slobod

[57] ABSTRACT

An X-ray apparatus a includes a high-voltage generator (1) a combination of an X-ray tube (7) with an anode (13) and a cathode (15), connected in series with the X-ray tube, a series connection of a first resistor (9) and a control element (11) which acts as a variable resistance and has an anode (17), a cathode (19) and a control electrode (25), and a control circuit (27) which is suitable to generate a control voltage which is dependent on the electric voltage between the anode and the cathode of the X-ray tube and which appears at an output (33) which is connected to the control electrode of the control element, the arrangement being such that the voltage between the anode and the cathode of the X-ray tube is always substantially equal to a predetermined value, regardless of the current flowing through the X-ray tube. For very simple and inexpensive construction of the apparatus, the control circuit (27) includes a voltage divider which is connected parallel to the series connection of the first resistor (9) and the control element (11) and which is formed by a series connection of a second resistor (29) and a third resistor (31), the junction point of the second and the third resistor being the output (33) of the control circuit.

8 Claims, 1 Drawing Sheet

X-RAY APPARATUS

BACKGROUND OF THE INVENTION

1. Field of the Invention

The invention relates to an X-ray apparatus, including a high-voltage generator which is connected across a series combination of an X-ray tube, a resistor and a control element which acts as a variable resistance and which was an anode, a cathode and a control electrode, the control circuit being suitable to generate a control voltage which is dependent on the electric voltage between the anode and the cathode of the X-ray tube and which appears at an output which is connected to the control electrode of the control element, to control the resistance of the control element in a manner to maintain the voltage between the anode and the cathode of the X-ray tube is always substantially equal to a predetermined value, regardless of the current flowing through the X-ray tube.

2. Description of the Related Art

An apparatus of this kind is known, for example from DE-B-21 16 064. The control element of the known apparatus is formed by a triode tube which is connected in the anode lead of the X-ray tube, in series with a parallel connection of the resistor and an inductance. The grid of the triode is connected to the output of the control circuit which comprises a control amplifier whose input is connected to a voltage divider consisting of two resistors which are connected in series between the anode and the cathode of the X-ray tube. The triode acts as a variable resistor whose resistance is controlled by the control amplifier so that the voltage drop across the series connection of the triode and the resistor is always constant, regardless of the magnitude of the current flowing through the X-ray tube. Because the high voltage supplied by the high-voltage generator is also constant, the X-ray tube always receives a substantially constant high voltage. This is important because the intensity of the X-rays produced by the tube depends on the tube voltage and the tube current. Generally speaking, the resistor is connected to a measuring circuit for determining the tube current, so that it cannot be omitted. However, when the tube current is increased in order to increase the intensity of the X-rays, the voltage drop across the resistor increases so that the tube voltage decreases. Consequently, a decelerating field is created for the electrons emanating from the cathode, which field counteracts the emission of electrons by the cathode. In order to achieve the desired emission current nevertheless, it is necessary to increase the cathode temperature so that enough electrons are released, despite the decelerating field. In order to reach this higher cathode temperature, the current in the filament of the cathode must be increased. Increasing the cathode temperature has a negative effect on the service life of the filament and hence on the service life of the X-ray tube. Therefore, this solution is not very desirable. The control element makes it possible for the tube voltage to remain always substantially constant. When the tube voltage decreases, the signal applied to the control amplifier via the voltage divider changes. As a result, the control amplifier influences the control electrode of the control element so that the resistance of this element also decreases. The overall resistance of the series connection of the control element and the resistor then also decreases, so that the voltage drop across this series connection remains constant despite an increased tube current. It is a drawback of the known solution, however, that it requires the use of a comparatively complex, expensive and slow control amplifier.

SUMMARY OF THE INVENTION

It is an object of the invention to provide an X-ray apparatus of the kind set forth in which a constant tube voltage is obtained by means of very simple and inexpensive means. To achieve this, the device in accordance with the invention is characterized in that the control circuit comprises a voltage divider which is connected parallel to the series connection of the first resistor and the control element and which comprises a series connection of a second resistor and a third resistor, the junction point of the second and the third resistor being connected to the output of the control circuit. Because the voltage divider is connected parallel to the series connection of the resistor and the control element, it carries approximately the same potential as the control element so that the control amplifier, serving inter alia to bridge the potential difference between the voltage divider connected to high voltage and the triode in the known device, can be dispensed with. Consequently, the control electrode in the device in accordance with the invention can be connected to the voltage divider either directly or possibly via a simple adaptation element. This represents a substantial simplification and saving in costs in comparison with the known apparatus.

A preferred embodiment of the apparatus in accordance with the invention is characterized in that the negative output terminal of the high-voltage generator is connected to a ground terminal, the series connection of the first resistor and the control element being connected on the one side to the cathode of the X-ray tube and on the other side to the ground terminal. This embodiment is particularly suitable for use in conjunction with X-ray tubes in which the anode carries a positive high voltage relative to the ground terminal, for example the so-called end-window tubes.

The control element preferably comprises a transistor or a combination of transistors. A very simple and inexpensive circuit is obtained when the transistor is an N-channel enhancement MOSFET whose source electrode constitutes the cathode, whose drain electrode constitutes the anode and whose gate electrode constitutes the control electrode. In order to prevent occasionally very high voltages between the gate and the source electrode of the MOSFET, a voltage reference element is connected preferably between the gate electrode and the source electrode of the MOSFET.

BRIEF DESCRIPTION OF THE DRAWING

These and other aspects of the invention will be described in detail hereinafter with reference to the drawing, wherein The sole

DETAILED DESCRIPTION OF THE PREFERRED

Figure 1:
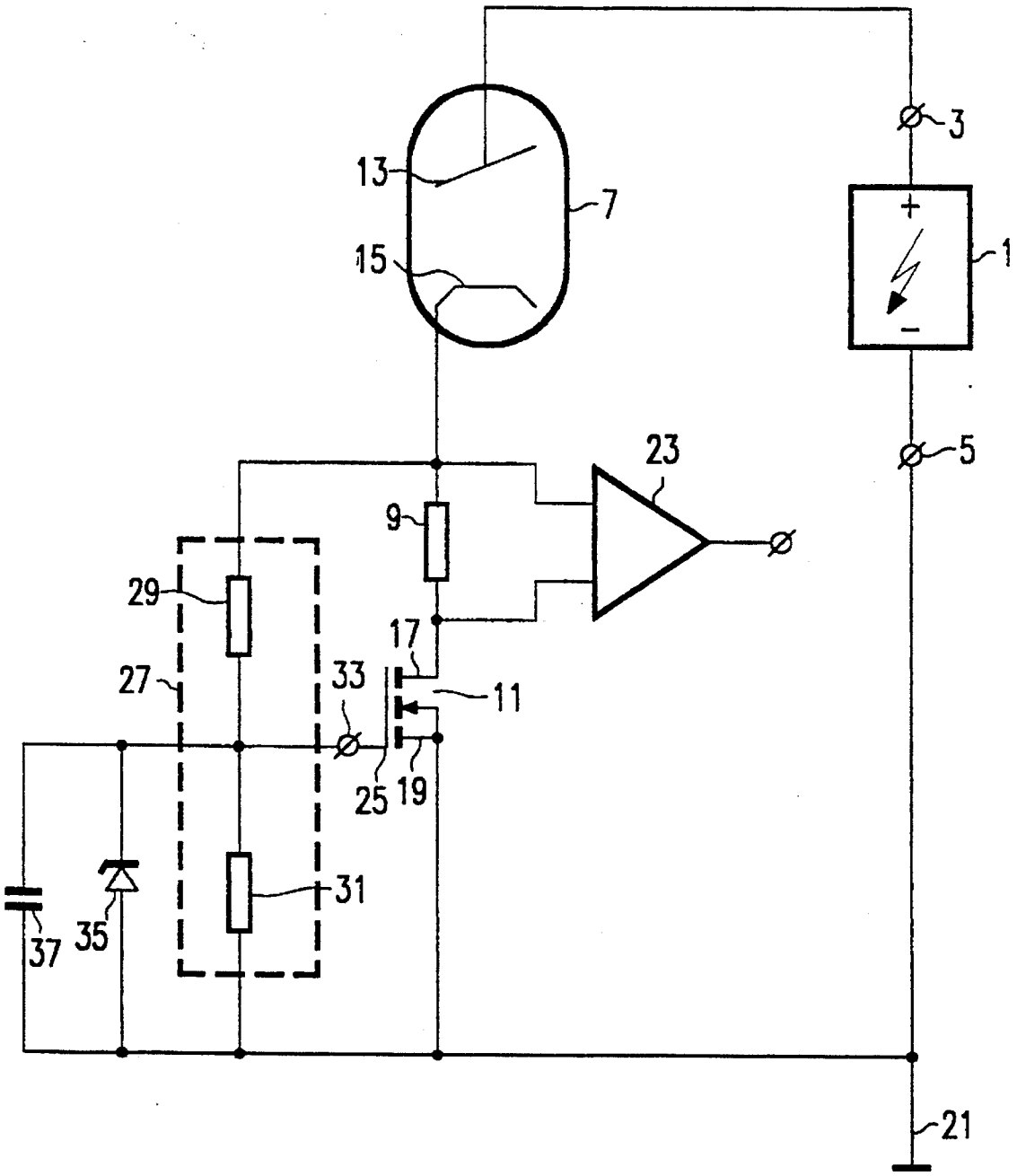
FIG. 1 shows a diagram of an embodiment of an X-ray apparatus in accordance with the invention.

The X-ray apparatus which is diagrammatically shown in FIG. 1 comprises a high-voltage generator 1 which is known per se so that it need not be described herein. An example of a suitable high-voltage generator can be found in U.S. Pat. No. 5,121,317. The high-voltage generator 1 comprises a positive output terminal 3 and a negative output terminal 5. The X-ray apparatus also comprises an X-ray tube 7 and a series connection of a first resistor 9 and a control element 11. The X-ray tube 7 comprises an anode 13 which is connected to the positive output terminal 3 of the high-voltage generator 1 and a cathode 15 which is connected to one end of the first resistor 9. The other end of the first resistor 9 is connected to an anode 17 of the control element 11, a cathode 19 of which is connected to a ground terminal 21 which itself is connected to the negative output terminal 5 of the high-voltage generator 1. The anodes of the X-ray tube 7 as well as of the control element 11 thus face, in an electrical sense, the positive output terminal 3 of the high-voltage generator 1, and the cathodes face the negative output terminal 5.

The two ends of the first resistor 9 are also connected to the inputs of an amplifier 23 which forms part of a circuit (not shown) for measuring the current through the X-ray tube 7. The control element 11 also comprises a control electrode 25 which is connected to an output of a control circuit 27 which is formed by a resistive voltage divider consisting of a second resistor 29 and a third resistor 31 which are connected in series. One end of the second resistor 29 is connected to the cathode 15 of the X-ray tube 7 and its other end is connected to one end of the third resistor 31, the other end of which is connected to the ground terminal 21. The junction point of the second and the third resistor constitutes the output of the voltage divider and is connected to the output 33 of the control circuit 27. In the embodiment shown, the control element 11 is formed by an N-channel MOSFET (Metal Oxide Semiconductor Field Effect Transistor) whose source electrode constitutes the cathode 19, whose drain electrode constitutes the anode 17 and whose gate electrode constitutes the control electrode 25. The control circuit 27 produces, at its output 33, a voltage which is proportional to the voltage across the series connection of the first resistor 9 and the control element 11. When this voltage is higher than the gate source threshold voltage of the MOSFET 11 (typically approximately 3 V), the MOSFET is turned on, the resistance between the source 19 and the drain 17 then decreasing as the voltage at the output 33 of the control circuit increases. The overall resistance of the series connection of the first resistor 9 and the MOSFET 11, therefore, also decreases and the voltage drop across the series connection decreases. Consequently, the cathode voltage of the X-ray tube 7, and hence also the voltage at the output 33, decreases again. In conjunction with the MOSFET 11 the control circuit 17 thus keeps the voltage difference between the cathode 15 and the ground terminal 21 (the offset voltage) at a substantially constant value of, for example from 5 to 15 V. Because the high voltage supplied by the high-voltage generator is also constant, the voltage difference between the anode 13 and the cathode 15 of the X-ray tube 7 also remains substantially constant, despite any changes in the tube current. The effect of such variations on the emission of X-rays, therefore, is not counteracted by decreasing the tube voltage. The secondary conditions for various measurements via the amplifier 23 (for example, a calibration and an actual measurement) will also be substantially the same due to the substantially constant offset voltage. As a result, the measurement result will not be adversely affected by the presence of the offset voltage. One condition to ensure suitable operation of the circuit is that for the maximum tube current occurring, the voltage drop across the first resistor 9 may not be greater than the desired offset voltage. The MOSFET 11 will then be fully turned on for the maximum tube current and will exhibit substantially no resistance between the source and the drain. A practical embodiment of the circuit in which the three resistors 9, 29 and 31 had the values 40Ω, 100 kΩ and 261 kΩ, respectively, was found to offer suitable results. In the said embodiment use was made of a MOSFET of the type BUK 456–100A (Philips).

In given circumstances, for example during brief breakdowns in the X-ray tube 7, very high voltage peaks might occur at the output 33 of the control circuit 27. These peaks could be detrimental to the MOSFET 11 which, generally speaking, cannot withstand gate-source voltages in excess of approximately 12 V. In order to prevent the adverse effects of such voltage peaks, a voltage reference element 35 is provided between the source electrode 19 and the gate electrode 25; the voltage reference element starts to conduct as soon as the voltage difference between these electrodes exceeds a predetermined value. In the present example the voltage reference element is formed by a zener diode with a zener voltage of, for example 12 V.

High-frequency variations of the offset voltage do not influence the emission by the X-ray tube 7, so that it is not necessary for the circuit to compensate for such variations. Therefore, a capacitor 37 of, for example 100 nF is connected between the gate electrode 19 and the source electrode 25, said capacitor constituting a short-circuit for high frequencies.

It will be evident that modifications of the described embodiment are feasible. For example, instead of an enhancement MOSFET use can be made of a depletion MOSFET; in that case it is necessary to connect a voltage inverter between the output 33 of the control circuit 27 and the gate electrode. Instead of a MOSFET, use can be made of another type of transistor, for example a bipolar transistor or a suitable combination of transistors. Instead of being included in the cathode lead, the circuit can also be inserted in the anode lead of the X-ray tube 7 and the circuit is also suitable for use in X-ray apparatus comprising separate high-voltage generators for the anode and the cathode of the X-ray tube, for example the apparatus described in EP-A-0 408 167.

I claim:

1. An X-ray apparatus, comprising:

a) a high-voltage generator which comprises a positive output terminal and a negative output terminal, b) a combination of an X-ray tube, which comprises an anode and a cathode, connected in series with a series connection of a resistor and a control element which acts as a variable resistance and which comprises an anode, a cathode and a control electrode, which combination is connected to the output terminals in such a manner that the anodes face the positive output terminal and the cathodes face the negative output terminal, c) a control circuit which is suitable to generate a control voltage which is dependent on the electric voltage drop across said series connection of said resistor and said control element and which appears at a control output which is connected to the control electrode of the control element, said control circuit being configured for controlling the resistance of the control element such that the voltage drop across said series connection of said resistor and said control element is substantially constant, regardless of the current flowing through the X-ray tube, and comprising a resistive voltage divider which is connected parallel to the series connection of the resistor and the control element and which has an output connected to the control output of the control circuit.

2. An X-ray apparatus as claimed in claim 1, characterized in that the negative output terminal of the high-voltage generator is connected to a ground terminal, the series connection of the resistor and the control element being connected on one side to the cathode of the X-ray tube and on the other side to the ground terminal.

3. An X-ray apparatus as claimed in claim 1, characterized in that the control element comprises at least one transistor.

4. An X-ray apparatus as claimed in claim 3, characterized in that the transistor is an N-channel enhancement MOSFET whose source electrode constitutes the cathode, whose drain electrode constitutes the anode, and whose gate electrode constitutes the control electrode of said control element.

5. An X-ray apparatus as claimed in claim 4, characterized in that a voltage reference element is connected between the gate electrode and the source electrode of the MOSFET.

6. An X-ray apparatus as claimed in claim 2, characterized in that the control element comprises at least one transistor.

7. An X-ray apparatus as claimed in claim 6, characterized in that the transistor is an N-channel enhancement MOSFET whose source electrode constitutes the cathode, whose drain electrode constitutes the anode and whose gate electrode constitutes the control electrode of said control element.

8. An X-ray apparatus as claimed in claim 7, characterized in that a voltage reference element is connected between the gate electrode and the source electrode of the MOSFET.

* * * * *